United States Patent [19]

Saitoh et al.

[11] Patent Number: 5,000,707

[45] Date of Patent: Mar. 19, 1991

[54] TILTING DEVICE FOR MARINE PROPULSION UNIT

[75] Inventors: Hideki Saitoh, Numazu; Naoyoshi Kuragaki, Hamamatsu, both of Japan

[73] Assignee: Sanshin Kogyo Kabushiki Kaisha, Hamamatsu, Japan

[21] Appl. No.: 290,445

[22] Filed: Dec. 27, 1988

[30] Foreign Application Priority Data

Dec. 28, 1987 [JP] Japan ..... 62-329643
Dec. 28, 1987 [JP] Japan ..... 62-329644

[51] Int. Cl.[5] ..... B63H 5/12
[52] U.S. Cl. ..... 440/61; 440/53
[58] Field of Search ..... 440/53, 61; 114/150, 114/171; 91/444–447

[56] References Cited

U.S. PATENT DOCUMENTS 4,565,528 1/1986 Nakase ..... 440/61
4,578,039 3/1986 Hall ..... 440/61

FOREIGN PATENT DOCUMENTS 60234096 5/1984 Japan .

*Primary Examiner*—Sherman Basinger
*Assistant Examiner*—Edwin L. Swinehart
*Attorney, Agent, or Firm*—Ernest A. Beutler

[57] ABSTRACT

Two embodiments of hydraulic tilt and trim units that include a manually operable valve for permitting flow between the chambers of the fluid motors so as to facilitate manual adjustment. In one embodiment, the valve is also automatically operable and is connected to the system so that it can relieve pressure in either of the chambers under impact.

5 Claims, 4 Drawing Sheets

TILTING DEVICE FOR MARINE PROPULSION UNIT

BACKGROUND OF THE INVENTION

This invention relates to a tilting device for a marine propulsion unit and more particularly to an improved hydraulically operated tilting device including an improved pressure relief and bypass valve for such devices.

As is well known, a wide variety of hydraulic systems have been employed for achieving tilt and trim movement of a marine outboard drive. With these types of devices, a hydraulic motor, normally of the reciprocating type is interposed between the transom of the watercraft and the outboard drive for adjusting the trim of the outboard drive in response to extension and contraction of the fluid motor. The fluid motor is powered by a fluid system that is contained, normally, within the hull of the watercraft and which may, at times, include a reversible electric driving motor and a reversible fluid pump. In connection with such systems, it is the normal practice to provide pressure relief valves in the circuitry to the fluid motor so as to relieve the pressure in the event an impact is encountered and protect the system from damage. Normally, such arrangements use two relief valves, one in communciation with each chamber of the fluid motor so as to absorb impacts in either direction. Of course, the use of such circuits employing two valves, one for each direction of movement, adds to the complexity of the system and thus can increase the cost and may, in fact, reduce the reliability of the system.

It is, therefore, a principal object of this invention to provide an improved tilting device for a marine propulsion unit.

It is another object of this invention to provide an improved pressure relief system for a hydraulic tilting device for a marine propulsion unit.

In addition to the pressure relief functions aforedescribed, frequently, hydraulic tilt and trim systems employ some form of manually operable bypass valve for permitting manual movement of the outboard drive without interference from the hydraulic motor that operates the tilt and trim unit. The manual relief valve must provide, in addition to a free source of fluid between the two chambers of the fluid motor, some arrangement for insuring makeup fluid can flow from the reservoir into the system so as to compensate for the change of area affected in one of the chambers by the varying displacement of the piston rod therein. Therefore, valves proposed for this purpose have been somewhat complicated and, furthermore, have required the use of separate tools to open and close the valve. The use of such a separate tool obvious presents certain difficulties.

It is, therefore, a further object of this invention to provide an improved manually operable bypass valve for a hydraulic tilt and trim unit of a marine outboard drive.

SUMMARY OF THE INVENTION

A first feature of this invention is adapted to be embodied in a hydraulic tilt and trim unit for an outboard drive mounted on the transom of a watercraft for movement between a plurality of trim positions. A fluid motor having a housing fixed to one of the transom and outboard drive defines a pair of fluid cavities divided by a movable member that is operably affixed to the other of the transom and outboard drive. In accordance with the invention, means are provided for relieving an excess pressure condition in either of the chambers comprising a single pressure responsive valve operable to relief pressure. First conduit means connect one of the chambers with the pressure responsive valve and second conduit means connects the other of the chambers with the pressure responsive valve. Check valve means preclude flow from the first conduit means to the second conduit means.

Another feature of the invention is adapted to be embodied in a manually operable bypass valve for a hydraulic tilt and trim unit of an outboard drive mounted on the transom of a watercraft for movement between a plurality of trim positions. A fluid motor has a housing affixed to one of the transom and outboard drive and defines a pair of fluid cavities that are divided by a movable member operably affixed to the other of the transom and outboard drives. The valve comprises a valve housing defining fluid passages in communcation with each of the chambers and with a reservoir. A valve element is mounted within the housing and is movable between a closed position wherein the chambers normally cannot communicate with each other and an open position wherein the chambers can communicate with each other and with the reservoir for manual movement. In accordance with the invention, a lever is pivotally supported on the valve housing and has a cam connection therewith for effecting movement of the valve element between its opened and closed positions in response to pivotal movement of the lever.

DETAILED DESCRIPTION OF THE PREFERRED EMBODIMENT

Figure 1:
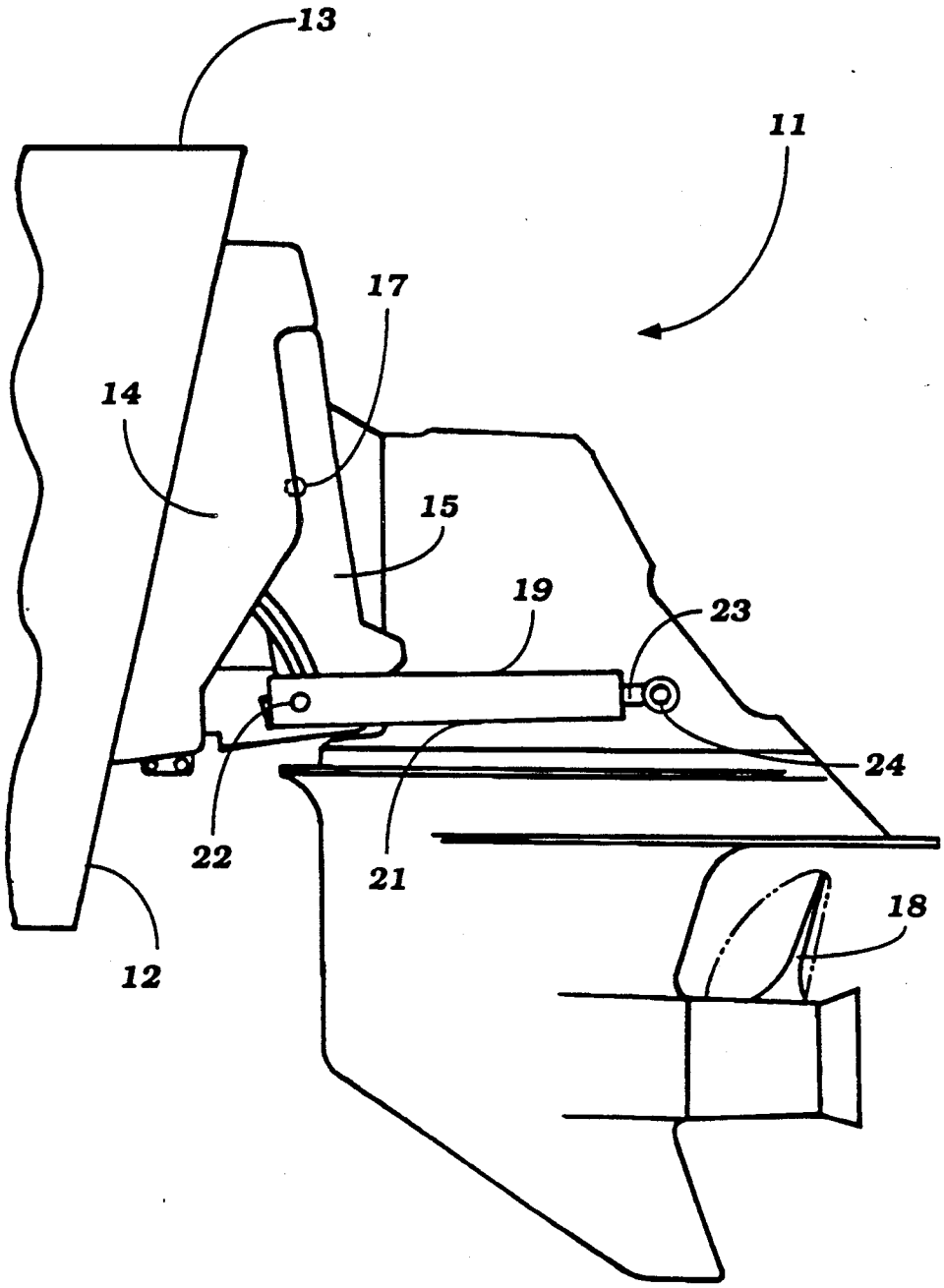
FIG. 1 is a partial side elevational view of a watercraft having a marine outboard drive constructed in accordance with an embodiment of the invention.

Referring first to FIG. 1, an outboard drive portion of an inboard/outboard drive assembly is indicated generally by the reference numeral 11 and is depicted as being attached to the transom 12 of a hull 13 of a watercraft. The marine outboard drive 11 includes a gimbal housing 14 that is affixed to the transom 12 and which supports a gimbal ring 15 for steering movement about a vertically extending steering axis. An outboard drive housing 16 is pivotally connected to the gimbal ring 15 by means of pivot pins 17 for tilt and trim movement.

An internal combustion engine (not shown) is mounted within the hull 13 and drives a propeller 18 of the outboard drive unit 11 through a conventional forward, neutral, reverse transmission (not shown). The construction of the outboard drive unit 11 per se is not necessary to understand the invention and, as will become apparent, the invention is adaptable for use with outboard drive units or outboard motors which units are collectively called "outboard drives" in the specification and claims.

The invention deals primarily with the hydraulic system for operating the tilt and trim of the outboard drive unit 11 and this comprises a pair of linear type fluid motors 19. Each fluid motor 19 includes a cylinder housing 21 that is journaled at one end on the gimbal ring by means of a pivot pin 22. A piston rod 23 extends from the cylinder housing 21 and is pivotally connected to the adjacent side of the outboard drive housing 16 by a pivot pin 24.

Figure 2:
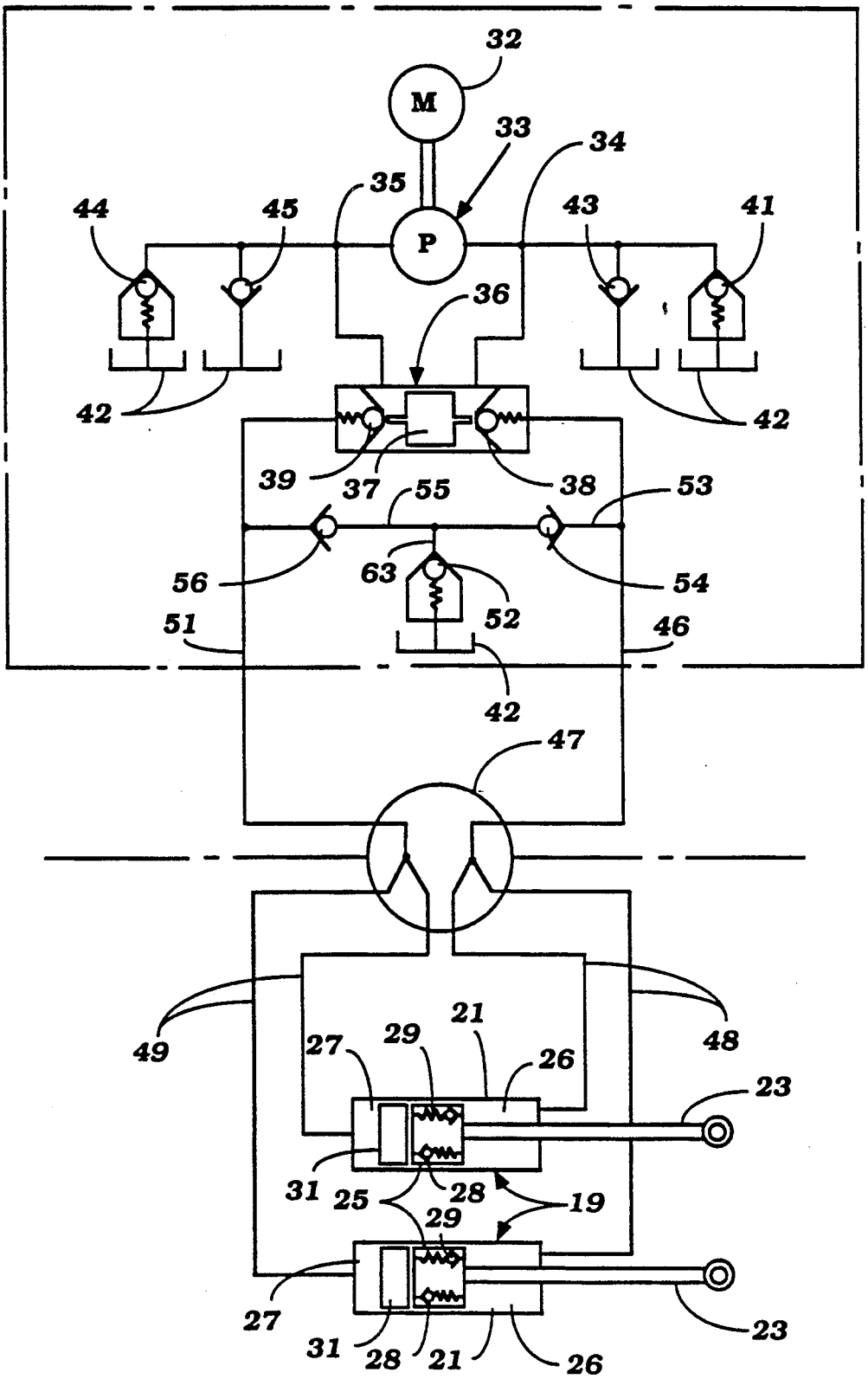
FIG. 2 is a schematic hydraulic diagram showing the system of the embodiment of FIG. 1.

The hydraulic circuitry for operating the system is illustrated in FIG. 2 wherein the internal details of the fluid motors 19 is depicted. Each fluid motor includes a piston 25 that is connected to the piston rod 23 in a known manner. The pistons 25 divide the housings 21 into first and second fluid chambers 26 and 27. A pressure responsive absorber valve 28 permits flow from the chamber 26 to the chamber 27 in the event of impact with an underwater obstacle. A pressure responsive check valve 29 permits return flow once the obstacle has been cleared. Floating pistons 31 are contained within the chambers 27 and serve to retain the outboard drive housing 16 in a trim adjusted position.

Contained within the hull of the watercraft 13 is the system for selectively pressurizing the chambers 26 or 27 to achieve power tilt and trim movement. This system includes a reversible electric motor 32 that drives a reversible fluid pump 33. The pump 33 has a pair of ports 34 and 35 that serve selectively as pressure or return ports depending upon whether tilt up or tilt down movement is being achieved.

The ports 34 and 35 communicate with a shuttle valve assembly, indicated generally by the reference numeral 36, which includes a shuttle piston 37 and a pair of check valves 38 and 39. The shuttle piston 37 has projections that are adapted to unseat the check valves 38 or 39 under an operation as will be described.

There is provided a pressure responsive relief valve 41 in communication with the port 34 that permits flow back to the reservoir 42 in the event a high pressure condition exists in the pumping system. In a like manner, a check valve 43 permits return flow for make-up purposes. A similar pressure relief valve 44 communicates the port 35 with the reservoir 42. A check valve 45 permits fluid to flow from the reservoir 42 to the port 43 for make-up purposes.

When the motor 32 and pump 33 are operated so as to pressurize the port 34, the pressure in the shuttle valve 36 will effect movement of the shuttle piston 37 to the left to manually open the check valve 39. The pressure will also cause the check valve 38 to unseat and open communication with a supply conduit 46 that extends to a distributor housing 47 that is mounted on the outboard drive unit at an appropriate location. Normally this will be on the gimbal housing 14. The distributor housing 47 communicates the conduit 46 with a pair of flexible conduits 48 that extend to the chambers 26 of the fluid motors 19. This will effect movement of the pistons 21 to the left so as to cause trim down operation.

During this operation, fluid is discharged from the chambers 27 through flexible hoses 49 to the distributor housing 47 for return to the shuttle valve 36 through a conduit 51. The fluid returns through the open check valve 39 to the port 35 so as to provide return fluid for the system.

For tilt or trim up operation, the motor 32 and pump 34 are driven in the opposite direction so as to pressurize the port 35 and cause the shuttle piston 36 to move to the right opening the check valve 38 so that the port 34 acts as a return port. The fluid pressure will open the check valve 39 and then flow through the conduit 51 and flexible hoses 49 to pressurize the chambers 27 and cause tilt or trim up movement.

The construction as thus far described may be considered to be conventional. In accordance with conventional systems, however, there are provided pressure responsive valves in the conduits 46 and 51 so as to relieve the hydraulic pressure in the event an impact is received on the lower unit 16 that is greater than that which may be relieved through the pressure responsive check valves 28 or 29. Such additional relief is necessary so as to avoid damage under high impact loading. As has been previously noted, the use of two separate relief valves for this purpose unduly complicates the system and, furthermore, there are times when it is desirable to permit manual release of the pressure so as to permit manual tilt and trim movement. In accordance with the invention, there is provided a relief valve and manual bypass valve assembly, indicated generally by the reference numeral 52 and shown in most detail in FIGS. 3 and 4. The valve 52 is positioned in a conduit system so that a single valve 52 can serve both purposes and relieve impact loads in either direction.

To this end, there is provided a first conduit 53 that extends from the conduit 46 to the relief valve 52. The conduit 53 includes a check valve 54 that permits flow from the conduit 46 to the conduit 53 and relief valve 52 but not flow in the opposite direction.

There is also provided a second conduit 55 that communicates the conduit 51 with the valve 52. A check valve 56 is provided that permits flow from the conduit 51 into the conduit 55 and relief valve 52 but not flow in the reverse direction. Therefore, as may be seen in the schematic view of FIG. 2, high pressure in either the chambers 26 or 27 of the fluid motors 21 can be relieved through the single relief valve 52.

Figure 3:
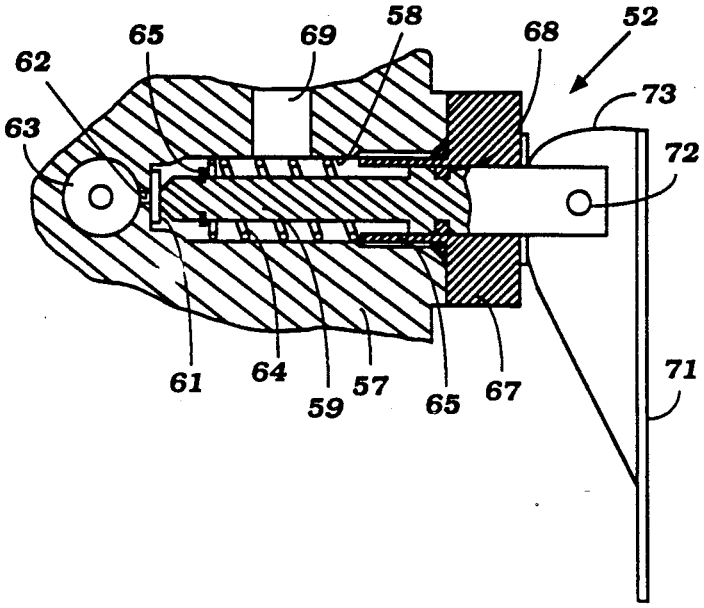
FIG. 3 is a cross-sectional view showing the pressure relief valve in its normal condition set for automatic operation.
Figure 4:
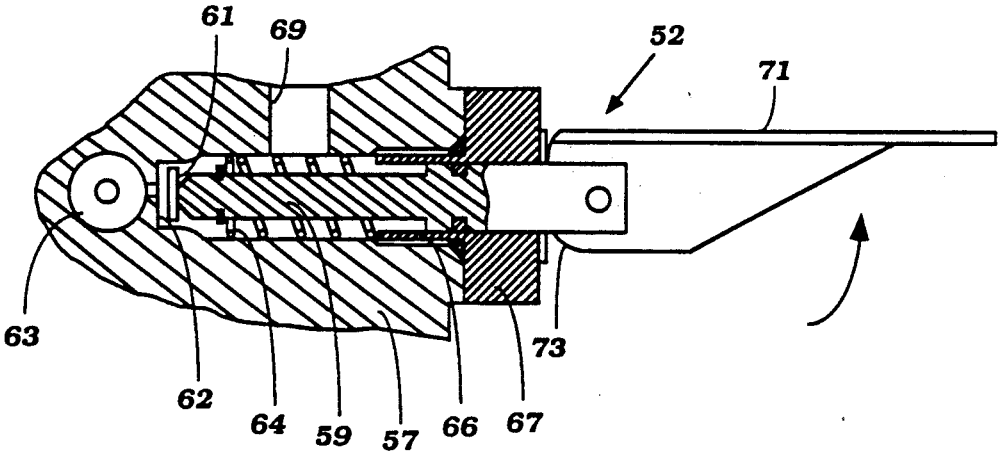
FIG. 4 is a cross-sectional view showing the valve in its manually operable bypass condition.

The construction of the valve 52 may be best understood by reference to FIGS. 3 and 4. The valve 52 is comprised of a valve housing 57 that has a bore 58 that slidably supports a valve plunger 59. The valve plunger 59 carries a valve element 61 at its end which is adapted to engage and control the flow through a port 62 formed in a passageway 63 that intersects the passages 55 and 53. The valve element 61 is normally urged into a closed position as shown in FIG. 3 by means of a coil compression spring 64 that engages a snap ring 65 formed on the valve plunger 59 and a sleeve portion 66 of a closure plate 67. It should be noted that the valve plunger 59 extends through a bore in the closure 67 and carries an O-ring seal 68 that effects sealing.

When the pressure rises in either the lines 53 or 55, the valve element 61 will be unseated and communicate the port 62 with a reservoir port 69 for returning the excess fluid to the reservoir 42 in the manner as aforedescribed.

It is also possible to open the valve 52 manually so to permit manual adjustment of the outboard drive unit 16. For this purpose, an operating lever 71 has a pivotal connection by means of a pivot pin 72 to the end of the valve plunger 59. The lever 71 has a cam surface 73 that is adapted to engage the end of the closure plug 67 when the lever 71 is rotated from the automatic position shown in FIG. 3 to the manual release position shown if FIG. 4 so as to draw the plunger 59 inwardly against the action of the spring 64 and move the valve element 61 away from its closed position with the passage 62.

Figure 5:
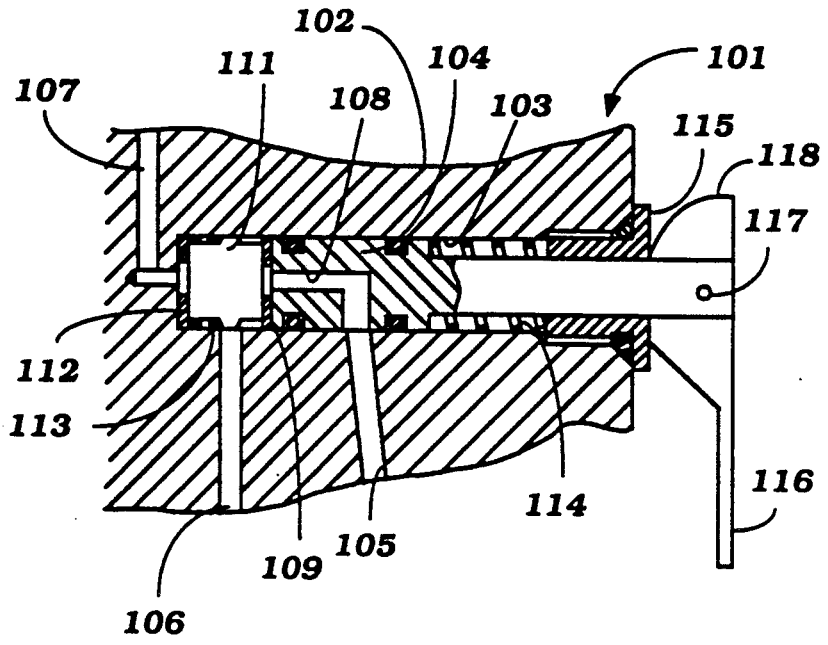
FIG. 5 is a cross-sectional view, in part similar to FIG. 3, showing another embodiment of the invention.
Figure 6:
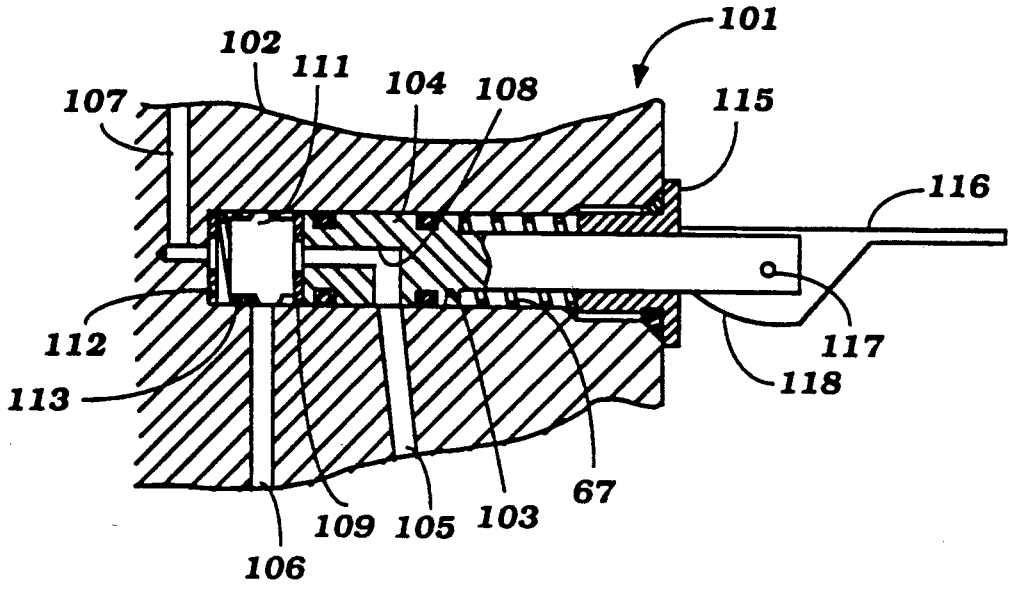
FIG. 6 is a cross-sectional view, in part similar to FIG. 4, showing this embodiment in its manual bypass condition.

FIGS. 5 and 6 show another embodiment of the invention and specifically one in which a control valve 101 is provided. The control valve 101 of this embodiment does not function as a relief valve as with the previously described embodiment of FIGS. 1 through 4. However, the valve 101 may be employed for selectively permitting communication between the opposite chambers of a hydraulic motor and the reservoir so as to accommodate manual tilt or trim operation. This type of device has particular utility in conjunction with an outboard motor that employs separate tilt and trim cylinders and which operates on a lower pressure than the type of system described in conjunction with FIGS. 1 through 4, that is intended primarily for use with the outboard drive portion of an inboard/outboard drive.

The valve 101 includes a valve body 102 having a bore 103 in which a plunger 104 is supported for reciprocation. The bore 103 is intersected at axial spaced locations by means of a pair of passages 105 and 106. The passages 105 and 106 communicate with the opposite chambers of the fluid motor through suitable passages (not shown). In addition, a relief passage 107 is connected to the reservoir for make-up fluid flow.

The valve plunger 104 is formed with an internal passageway 108 that has an end portion which overlaps the port 105 in both the closed position of the valve 101 as shown in FIG. 5 and the opened position as shown in FIG. 6. A seal 109 is carried at the end of the plunger 104 and normally engages a spring biased valving element 111 when the valve 101 is in its closed position as shown in FIG. 5. A further seal 112 formed at the opposite end of the valving element 111 closes the port 107 so that the port 106 cannot communicate with it in this closed position. It should be noted that the valving element 111 has circumferentially spaced projections that engage the bore 103 so as to provide support for the valving element 111 but which will not interfere with the flow between its opposite ends, as will now be described.

A light compression spring 113 normally urges the valving element 111 toward the right. However, when the valve plunger 104 is in its closed position, being retained in this position by a coil spring 114.

As with the previously described embodiment, the valve plunger 104 is slidably supported within a closure plug 115 and has an operating lever 116 connected to its end by a pivot pin 117. The lever 116 has a cam surface 118 that is adapted to engage the closure plug 115 when the lever 116 is pivoted from the closed position to the opened position as shown in FIG. 6.

When the lever 116 is pivoted to its opened position, the plunger 104 will be moved away from the valving element 111 so as to permit flow from the port 105 to the port 106. In addition, the light compression spring 113 moves the valving member 111, which has a lesser stroke of travel than the plunger 104, to an opened position so that make-up fluid can flow from the reservoir to the system through the passage 107.

It should be readily apparent, therefore, that several embodiments of the invention have been illustrated and described. In each embodiment, a valve is provided that can be opened manually and in one embodiment this valve also can be opened automatically to act as a pressure relief valve. This pressure relief valve is connected into the system in such a way a single relief valve can operate to relieve pressure in either chamber of a fluid motor.

Although several embodiments of the invention have been illustrated and described, various changes and modifications may be made without departing from the spirit and scope of the invention, as defined by the appended claims.

We claim:

1. In a hydraulic tilt and trim unit for an outboard motor drive mounted on the transom of a watercraft for movement between a plurality of trim positions, a fluid motor having a housing fixed to one of the transom and the outboard drive and defining a pair of fluid cavities divided by a movable member operatively affixed to the other of said transom and outboard drive, control valve means for selectively pressurizing either of said cavities from a fluid pressure source and communicating the other of said cavities to an exhaust, the improvement comprising means for relieving an excess pressure condition in each of said chambers to the exhaust comprising a single pressure responsive valve openable to relieve pressure from either of said chambers to the exhaust, a first conduit connecting one of said chambers to said pressure responsive valve, a second conduit connecting the other of said chambers to said pressure responsive valve, and check valve means operable at a lower pressure than said pressure responsive valve for permitting flow from said first chamber to said pressure responsive valve and from said second chamber to said pressure responsive valve said check valve means precluding communication between said first chamber and said second chamber.

2. In a hydraulic tilt and trim unit as set forth in claim 1 further including a second pressure responsive valve for permitting flow from one of the chambers to the other of the chambers and a third pressure responsive valve for permitting flow from the other chamber to the one chamber, said second and said third pressure responsive valve being openable at a different pressure than said single pressure responsive valve, said single pressure responsive valve being openable to permit flow between said chambers when the pressure rise exceeds the capacity of the second and third pressure responsive valve.

3. In a hydraulic tilt and trim unit as set forth in claim 1 further including manually operable means for opening the single pressure responsive valve.

4. In a hydraulic tilt and trim unit as set forth in claim 3 further including a second pressure responsive valve for permitting flow from one of the chambers to the other of the chambers and a pressure responsive valve for permitting flow from the other chamber to the one chamber, said second and said third pressure responsive valve being openable at a different pressure than said size pressure responsive valve, said single pressure responsive valve being openable to permit flow between said chambers when the pressure rise exceeds the capacity of said second and said third pressure responsive valve.

5. In a hydraulic tilt and trim unit as set forth in claim 4 wherein the single pressure responsive valve comprises a housing having a bore, a plunger slidably supported within said bore and carrying a valve member for controlling the flow between the conduits and a reservoir and cam means carried by said plunger and movable between a first position wherein said plunger can be opened by excess pressure and a second position wherein said plunger is manually opened.

* * * * *